US006808339B2

(12) United States Patent
Peterson et al.

(10) Patent No.: US 6,808,339 B2
(45) Date of Patent: Oct. 26, 2004

(54) PLANTABLE GEOSYNTHETIC REINFORCED RETAINING WALL

(75) Inventors: John E. Peterson, Sacramento, CA (US); Deh-Jeng Jang, Sacramento, CA (US)

(73) Assignee: State of California Department of Transportation, Sacramento, CA (US)

( * ) Notice: Subject to any disclaimer, the term of this patent is extended or adjusted under 35 U.S.C. 154(b) by 0 days.

(21) Appl. No.: 10/227,474

(22) Filed: Aug. 23, 2002

(65) Prior Publication Data

US 2004/0037654 A1 Feb. 26, 2004

(51) Int. Cl.[7] ..... E02D 29/02
(52) U.S. Cl. ..... 405/262; 405/284; 405/286
(58) Field of Search ..... 405/262, 284, 405/286, 272, 273

(56) References Cited

U.S. PATENT DOCUMENTS

| | | | | |
|---|---|---|---|---|
| 1,773,579 A | | 8/1930 | Flath | |
| 1,787,199 A | | 12/1930 | Huntoon | |
| 1,818,056 A | | 8/1931 | Ferguson | |
| 1,907,053 A | | 5/1933 | Flath | |
| 2,034,851 A | | 3/1936 | Wichmann | |
| 2,092,385 A | * | 9/1937 | Arble | 405/273 |
| 2,315,441 A | | 3/1943 | McDaniel | |
| 2,972,870 A | | 2/1961 | Cooper | |
| 4,244,665 A | | 1/1981 | Neumann | |
| 4,266,890 A | | 5/1981 | Hilfiker | |
| 4,278,364 A | | 7/1981 | Frehner | |
| 4,324,508 A | | 4/1982 | Hilfiker | |
| 4,384,810 A | * | 5/1983 | Neumann | 405/284 |
| 4,512,685 A | | 4/1985 | Hegle | |
| 4,557,634 A | * | 12/1985 | Vidal | 405/286 |
| 4,572,711 A | | 2/1986 | Benson | |
| 4,655,646 A | | 4/1987 | Babcock | |
| 4,661,023 A | | 4/1987 | Hilfiker | |
| 4,664,562 A | | 5/1987 | Clark | |
| 4,668,129 A | | 5/1987 | Babcock | |
| 4,684,287 A | | 8/1987 | Wojciechowski | |
| 4,815,897 A | * | 3/1989 | Risi et al. | 405/284 |
| 4,818,150 A | * | 4/1989 | Jaecklin | 405/262 |
| 4,825,619 A | | 5/1989 | Forsberg | |
| 4,914,876 A | | 4/1990 | Forsberg | |
| 4,930,939 A | * | 6/1990 | Jaecklin | 405/262 |
| 4,960,349 A | * | 10/1990 | Willibey et al. | 405/262 |
| 4,968,186 A | | 11/1990 | Ogorchock | |

(List continued on next page.)

FOREIGN PATENT DOCUMENTS

AT 277078 12/1969

OTHER PUBLICATIONS

Fornit—Biaxial Geogrid Reinforcement, published by Huesker, Charlotte, North Carolina; unknown date.
Huesker—Engineering with Geosynthetics, Published by Huesker Synthetic GmbH & Co.; Germany; unknown.

*Primary Examiner*—Frederick L. Lagman
(74) *Attorney, Agent, or Firm*—Harris Zimmerman

(57) ABSTRACT

A modular retaining watt has tiers of headers which extend into compacted backfill material and tiers of stretchers which extend between headers to form the front face of the wall. Vertical pins, extending between successive headers in each stack of headers, facilitate precise emplacement of headers during construction of the wall. Layers of geosynthetic mesh reinforcement reinforce the load bearing capability of the backfill. Load forces in the backfill are sustained by forward ends of the layers of geosynthetic mesh reinforcement, which extend upward in front of the backfill and then backward into the backfill, instead of being sustained by the stretchers. A sizable space behind the stretchers may be filled with loose topsoil to facilitate growth of landscaping plantings on the face of the wall.

17 Claims, 6 Drawing Sheets

U.S. PATENT DOCUMENTS 4,990,032 A * 2/1991 Smith ..... 405/286
5,030,035 A * 7/1991 Babcock ..... 405/262
5,044,834 A 9/1991 Janopaul
5,108,232 A * 4/1992 Strassil ..... 405/286
5,139,369 A * 8/1992 Jaecklin ..... 405/262
5,224,801 A 7/1993 Quaney
5,259,704 A 11/1993 Orgorchock
5,370,480 A * 12/1994 Quaney ..... 405/284
5,499,891 A 3/1996 Klenert
5,507,599 A 4/1996 Anderson
5,511,910 A 4/1996 Scales
5,586,841 A 12/1996 Anderson
5,642,968 A 7/1997 Anderson
5,688,078 A 11/1997 Hammer
5,788,420 A 8/1998 Scales
5,807,030 A 9/1998 Anderson
5,913,790 A 6/1999 Dawson
5,984,589 A 11/1999 Ciccarello
6,036,405 A * 3/2000 Nove et al. ..... 405/284
6,086,288 A 7/2000 Ruel
6,336,773 B1 1/2002 Anderson
6,338,597 B1 1/2002 Rainey

* cited by examiner

PLANTABLE GEOSYNTHETIC REINFORCED RETAINING WALL

BACKGROUND OF THE INVENTION

This invention relates to retaining walls for stabilizing inclined land surfaces. More particularly the invention relates to modular retaining walls in which tiers of header members extend into structural backfill material and support stretcher members which extend horizontally between the header members and which form the front face of the wall.

The weight of the backfill material behind the face of a retaining wall creates a load force which becomes progressively greater at greater depths within the backfill. The load force is increased by roadways and vehicles or structures which may be situated on top of the backfill. The load force is primarily directed downward against subsoil but also has a horizontal component which must be sustained by the wall.

One known type of retaining wall has a modular construction which includes spaced apart columns of precast concrete header members which extend from the front face of the wall into the backfill material. The front face is formed by precast concrete stretcher members which extend horizontally between the headers and which are supported by the headers. Compacted backfill extends between the headers to the back surfaces of the stretcher members. Thus the stretcher members of the prior wall constructions must be sufficiently massive to sustain the horizontal component of load force in the backfill. The prior stretcher members also partially support the weight of overlying headers and must also be sufficiently massive for this purpose.

Retaining walls can be more attractive if landscaping plants are grown on the face of the wall. The prior wall constructions described above are not particularly conducive to plantings. While a strip of the backfill is exposed at each tier of the wall, it is undesirably narrow for planting purposes because of the shape, bulk and location of the load force resisting stretcher members. Further, the compacted backfill material which is exposed at the face of prior modular retaining walls may not be well suited for the growing of plants.

Header members of some prior modular retaining walls are linked together by thin projecting ribs which extend upward from the top of each header between spaced apart ribs on the bottom of the overlying header. The projecting ribs are relatively fragile portions of the headers which are susceptible to damage during construction of the wall. The ribs also allow forward or backward displacement of the header members relative to each other rather than establishing and maintaining a uniform batter or inclination of the face of the wall.

The present invention is directed to overcoming one or more of the problems discussed above.

BRIEF SUMMARY OF THE INVENTION

In one aspect the present invention provides a retaining wall for stabilizing compacted structural backfill. A plurality of spaced apart columns of header members extend into the compacted backfill from a front surface of the backfill and also extend out from the front surface of the backfill to a front face of the wall. Front ends of the header members have inclined arms which extend outward and upward at the front face of the wall. A plurality of horizontal stretcher members extend between the header members at the front face of the wall and are supported by the inclined arms of the header members. The retaining wall further includes a plurality of vertically spaced layers of geosynthetic mesh reinforcement extending between the columns of header members and extending backward into the compacted backfill from the front surface of the backfill. The layers of geosynthetic mesh reinforcement have forward ends which turn upward at the front surface of the compacted backfill and then extend back into the compacted backfill. A volume of planting soil is disposed between the stretcher members and the upturned forward ends of the layers of geosynthetic mesh reinforcement and forms exposed tiers of planting soil at the front face of the retaining wall.

In another aspect the invention provides a retaining wall for compacted structural backfill wherein the retaining wall includes a plurality of cast concrete header members stacked in spaced apart vertically extending columns of header members which header members extend into the structural backfill from a front face of the wall. The header members have bases which rest upon an underlying header member and have front and rear post portions which extend up to the base of an overlying header member. Front ends of the header members have arms which extend outward and upward at the face of the wall at locations which are in front of the compacted structural backfill. A plurality of horizontal stretcher members extend between the columns of header members at the front face of the wall and are supported by the inclined arms of the header members. The stretcher members are spaced apart from header members other than the particular header members which support the stretcher member. A plurality of vertically spaced horizontal layers of geosynthetic mesh reinforcement extend between the columns of header members and extend backward therefrom within the backfill. The layers of geosynthetic mesh reinforcement have upturned forward ends which extend upward at the front of the compacted backfill and then extend back into the backfill. Planting soil is disposed between the stretcher members and the upturned forward ends of the layers of geosynthetic mesh reinforcement and forms tiers of planting soil at the front face of the wall.

In still another aspect the invention provides a retaining wall having a plurality of spaced apart vertical columns of stacked header members which extend into backfill material and a plurality of stretcher members which extend horizontally between front portions of the header members. The header members have flat top surfaces and flat bottom surfaces. A plurality of pins extend vertically from holes in the top surfaces of the header members into holes in the bottom surfaces of overlying ones of the header members and fix the positions of the header members relative to each other during construction of the wall.

The invention provides a modular retaining wall construction in which the horizontal component of load force in the backfill is resisted by layers of geosynthetic mesh reinforcement within the backfill rather than by the stretcher members which form the face of the wall. Load force on the stretcher members is further minimized as the stretcher members are not contacted by overlying header members and thus need not provide support for overlying structure. Consequently the stretcher members may be thinner than would otherwise be required and may be spaced outward from the front surface of the compacted backfill. This provides a very sizable space between the stretcher members and the front of the backfill which space is filled with relatively loose topsoil or the like. Broad tiers of the topsoil are exposed at the tops of the stretcher member. These conditions greatly facilitate planting and cultivation of plants on the face of the wall. In the preferred form of the invention, the header members are interlinked by vertical pins which fix the positions of the header members relative to each other to maintain the desired inclination of the front face of the wall during construction of the wall.

The invention, together with further objects and advantages thereof, may be further understood by reference to the following detailed description of the invention and by reference to the accompanying drawings.

DETAILED DESCRIPTION OF THE INVENTION

Figure 1:
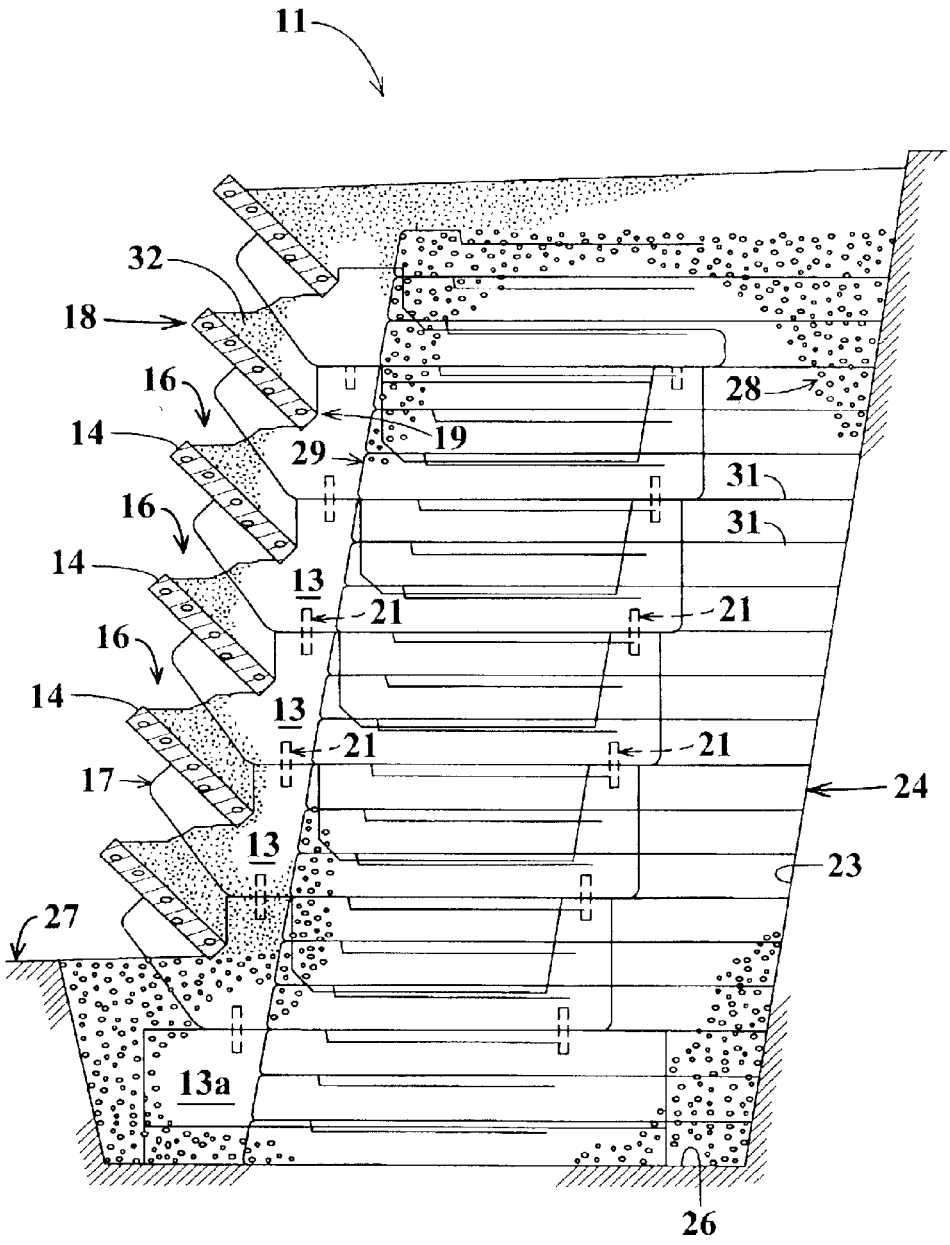
FIG. 1 is an elevation view of a retaining wall embodying the invention.
Figure 2:
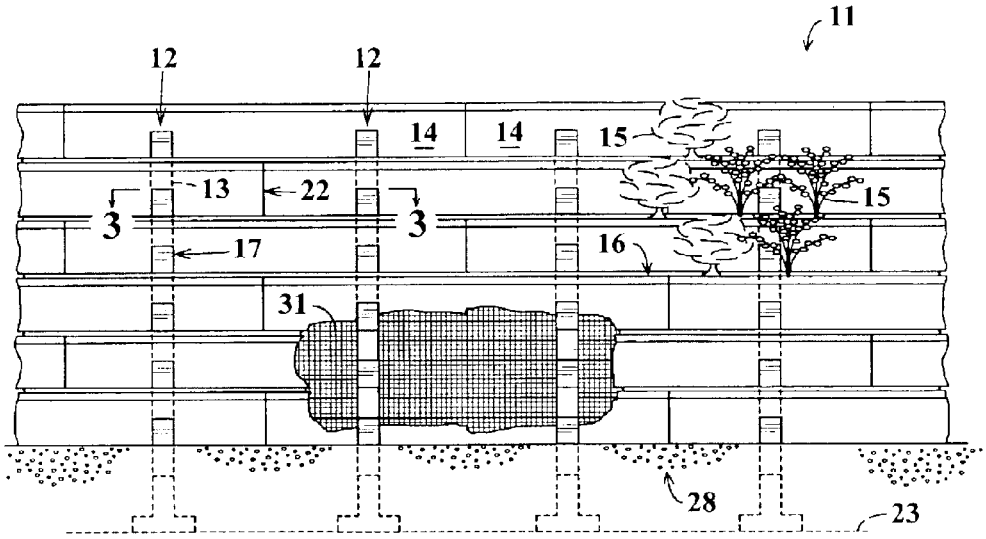
FIG. 2 is a frontal elevation view of the retaining wall of FIG. 1 with a portion of the structure being broken out in order to illustrate interior components.

Referring initially to FIGS. 1 and 2 of the drawings, components of a modular retaining wall 11 embodying the invention include horizontally spaced apart columns 12 of header members 13 which support horizontally extending stretcher members 14 that form the front of the wall. Successive rows of aligned stretcher members 14 extend along the front of the wall at progressively greater heights and form a series of vertically spaced tiers 16 at which landscaping plants 15, shown in FIG. 2, may be planted.

Referring again to FIGS. 1 and 2 in conjunction, the header members 13 of each column 12 are arranged in a stack in which each header member other than the lowest one rests on and is supported by the next lower header member. Each header member 13 other than the lowermost header members has an inclined arm 17 which extends outward and upward at the front of the header member. Each stretcher member 14 rests on and is supported by the inclined arms 17 of two header members 13 which are in separate spaced apart ones of the columns 12 of header members. The stretcher members 14 have a flat rectangular shape and the inclination of header arms 17 causes the stretcher members to be tilted with the forward edges 18 of such members being at a higher elevation than the back edges 19 of the members.

It is usually preferable that the face of a retaining wall 11 be inclined away from a strictly vertical orientation so that it leans towards the material which is being retained. Among other advantages, this increases the breadth of the tiers 16 at which plants 15 may be cultivated. As shown in FIG. 1 in particular, a desired inclination of the wall 11 is established by placing each header member 13 to extend slightly more rearwardly than the next underlying header member. Precise emplacement of successive header members 13 in this manner is facilitated by front and rear vertically oriented pins 21 which extend upward from each header member into the overlying header member. The pins 21, which will hereinafter be further discussed, also act to inhibit lateral and longitudinal shifting of the header members 13 relative to each other during construction of the wall.

Referring to FIG. 2 in particular, the preferred length of the stretcher members 14 corresponds substantially to twice the spacing between successive columns 12 of header members 13. This allows the abutments 22 between the successive stretcher members 14 of each row of stretcher members to be located midway between a pair of header member columns 12. Preferably the stretcher member abutments 22 of alternate ones of the rows of stretcher members 14 are located between different pairs of the header member columns 12. This causes stretcher members 14 of successively higher rows of stretcher members 14 to have an interleaved appearance when viewed from a location in front of the wall 11. Shorter and longer stretcher members 14 can be used to establish vertically aligned abutments 22 at corners or other angles in the wall 11 and to provide vertical ends or sloped ends of the wall as may be called for by the contours of the site.

Referring again to FIG. 1, in some instances an excavation 23 of the original ground at the site may be made in preparation for emplacement of the retaining wall 11. In other instances existing ground contours and available space may enable emplacement of the wall without major excavation. In this particular example of the invention an excavation 23 is present and has a rear slope 24 and a bottom 26 which is below the level 27 of the ground or pavement which extends outward at the base of the wall 11. The excavation 23 may be broad enough to situate the columns 12 of header members 13 a distance outward from the rear slope 24 of the excavation if necessary to provide space for a broad roadway on top of the wall 11 or for other reasons.

The front portions of header members 13 extend out of compacted structural backfill 28 which fills the regions between the more rearward portions of the header members and which extends backward from the header members. The front boundary 29 of the compacted backfill 28 is defined by upturned front ends of vertically spaced apart layers 31 of geosynthetic mesh reinforcement which extend within the backfill and which will hereinafter be described in more detail. Front boundary 29 of the compacted backfill is spaced apart from stretcher members 14 and a vertically continuous filling of relatively loose planting soil 32 is situated between the stretcher members 14 and the front backfill boundary 29. The previously described uptilted orientation of the stretcher members 14 leaves broad strips of planting soil 32 exposed at the successive tiers 16 of the wall 11.

The term "structural backfill" as used herein and in the appended claims should be understood to refer to filler material having a high load bearing capacity and is typically compacted aggregate of the known type which is composed of gravel intermixed with smaller soil particles. The term "planting soil" as used herein and in the appended claims should be understood to refer to relatively loose material selected for its suitability for growing beds of plants and may variously be high quality topsoil or any of the known planting mixes.

Figure 3:
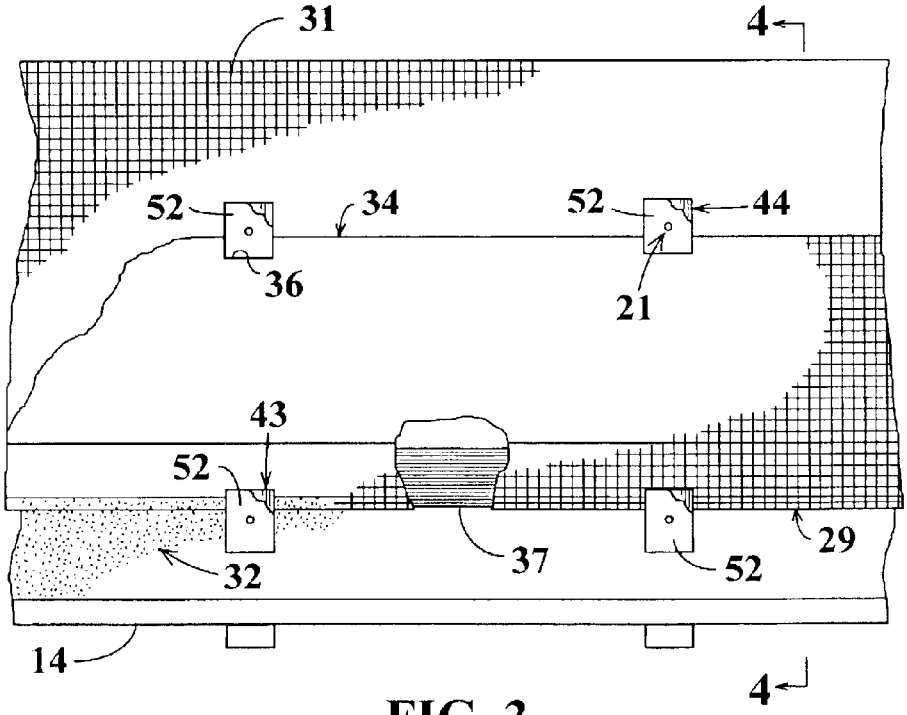
FIG. 3 is a plan section view of a portion of the retaining wall of the preceding figures taken along line 3—3 of FIG. 2.
Figure 4:
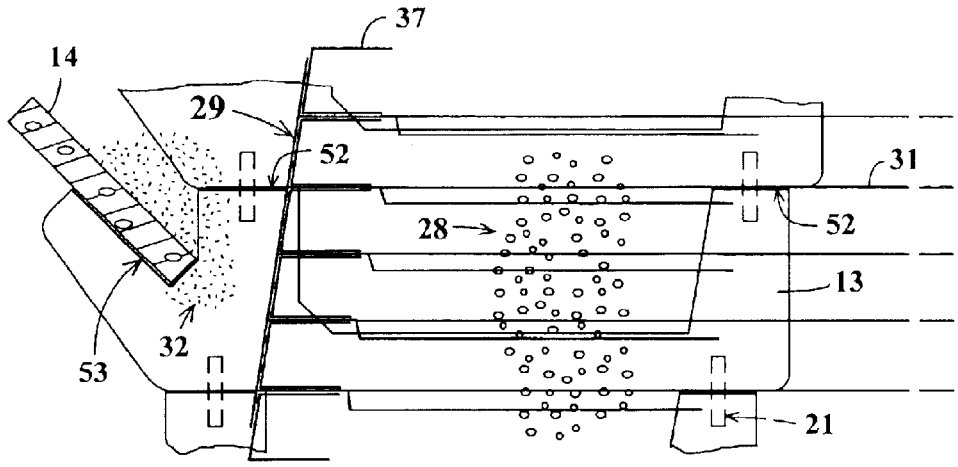
FIG. 4 is a cross section view taken along line 4—4 of FIG. 3.
Figure 5:
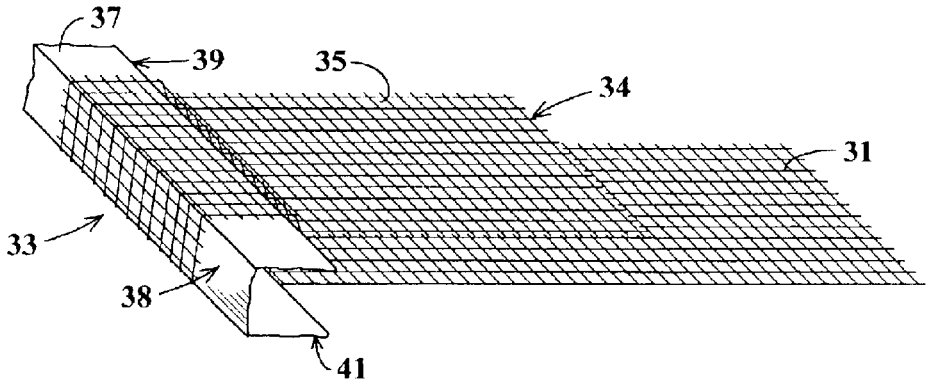
FIG. 5 is an isometric view of geosynthetic mesh reinforcement which is a component of the retaining wall.

Referring jointly to FIGS. 3, 4 and 5, the layers 31 of geosynthetic mesh reinforcement reinforce the load bearing capacity of the body of backfill 28 and prevent the horizontal component of the load force from being exerted against the planting soil 32 and stretcher members 14. The geosynthetic mesh reinforcement may be of one of the known forms and is typically a net formed of high strength synthetic polymer. Backfill aggregate penetrates the openings 35 in the geosynthetic mesh reinforcement and interlocks the backfill with the mesh.

Reinforcement of the backfill 28 at the front boundary 29 of the backfill is enhanced by a front portion 33 of each layer 31 which is angled to extend up to the next higher layer. The front portion 33 is further angled to extend backward for a short distance along the underside of the next higher layer 31 and then has an end section 34 which continues back into the backfill at a level which is below the underside of the next higher layer 31. The small vertical spacing between the end section 34 of each layer 31 and the next higher layer 31 assures that both interlock with the structural backfill at this location.

The vertical spacing of the successive Layers 31 of geosynthetic mesh reinforcement may be varied to accommodate to differences in the inherent load bearing capacity of the particular backfill 28 and to differences in the load force to which the wall 11 will be subjected. The degree of reinforcement which the geosynthetic mesh reinforcement provides is dependent on the vertical spacing of the layers 31 and becomes greater as the spacing is reduced. In this particular example, layers 31 are coplanar with the tops and bottoms of each header member 13 and two additional layers 31 are present between the top and bottom of each header member. As best seen in FIG. 3, openings 36 are cut into the layers 31 of geosynthetic mesh reinforcement where portions of the header members 13 extend through the mesh.

Retention of backfill 28 at the front boundary 29 of the backfill is further provided for by barriers 37 formed of porous sheet material. Each barrier 37 has an intermediate portion 38 which extends upward at boundary 29 within the front portion 33 of a layer 31 of geosynthetic mesh reinforcement and has upper and lower portions 39 and 41 respectively which extend rearwardly into the backfill along the layer for a short distance. The barrier 37 material separates the backfill 28 and planting soil 32 and inhibits migration of soil particles from the structural backfill to the planting soil.

The geosynthetic mesh reinforcement of layers 31 is typically brought to the construction site in the form of rolled strips of the mesh which are then unrolled as the layers 31 are emplaced. To assure continuity it is preferable that adjacent ends of the barrier 37 material be overlapped with each other at the front of each layer 31 of geosynthetic mesh reinforcement.

Figure 8:
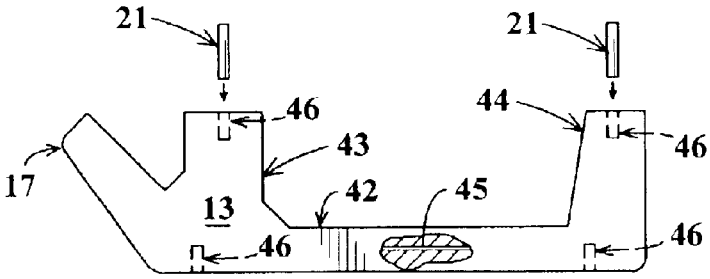
FIG. 8 is a side elevation view of an intermediate header member which members are also components of the modular retaining wall.
Figure 9:
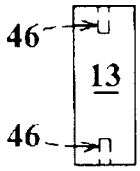
FIG. 9 is a back end view of the intermediate header member of FIG. 8.

Referring jointly to FIGS. 8 and 9, each header member 13 other than the lowermost and uppermost header members preferably has a longitudinally extending base portion 42 and a front post portion 43 and rear post portion 44 which extend upward from the ends of the base portion. The previously described inclined arm 17 of the header member 13 extends outward and upward from the front end of base portion 42. This header member configuration provides the necessary load bearing capability while avoiding unnecessary bulk and weight.

The bottom surface of the base portion 42 and the top surfaces of the front and rear post portions 43 and 44 are flat and thus have no relatively fragile ribs or other projections. Holes 46 extend down into the tops of the post portions 43 and up into the base portion 42 to receive the previously described pins 21. The header members 13 are preferably strengthened by internal reinforcing rods 45 of the known type.

Figure 6:
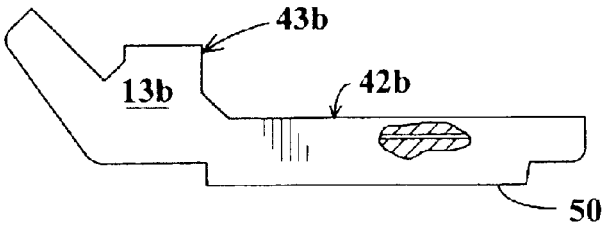
FIG. 6 is a side elevation view of a top header member which members are components of the modular retaining wall.
Figure 7:
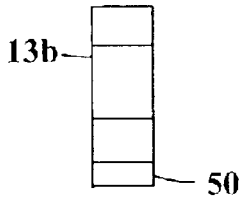
FIG. 7 is a back end view of the top header member of FIG. 6.

Referring to FIGS. 6 and 7, the uppermost header members **13*b* preferably have a configuration which differs from that of the intermediate header members 13 in that no upwardly extending rear post portion is needed as the uppermost header members do not support overlying header members. The front post portions 43*b* of the uppermost header members 13*b* may be relatively truncated and may extend upward only far enough to provide a seat for a stretcher member in the previously described manner. Referring jointly to FIGS. 6, 7 and 8, the uppermost head members 13*b* are shaped to interlock with the next underlying intermediate header members 13. In particular, the base portion 42*b* of the uppermost header member 13*b* is formed with a downward extending key section 50 shaped to fit into the region between the tops of the front and rear post portions 43 and 44 of the underlying intermediate header member 13**.

Figure 10:
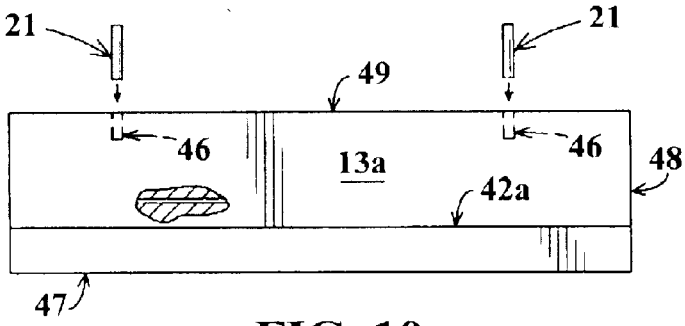
FIG. 10 is a side elevation view of a bottom header member which members are further components of the retaining wall.
Figure 11:
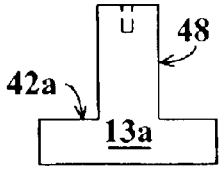
FIG. 11 is a back end view of the bottom header member of FIG. 10.

Referring to FIGS. 10 and 11, the lowermost header members **13*a* have a relatively broad base portion 42*a* with a flat undersurface 47. A rectangular upright portion 48 extends upward from the base portion 42*a* and has a flat top surface 49, with pin receiving holes 46**, on which the next higher header member rests.

Figure 12:
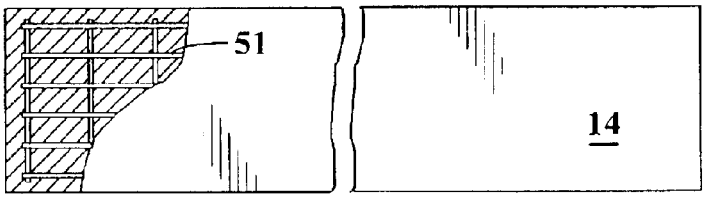
FIG. 12 is a foreshortened frontal view of a stretcher member which members form the front face of the retaining wall.
Figure 13:
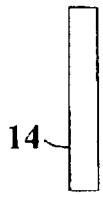
FIG. 13 is an end view of the stretcher member of FIG. 12.

Referring to FIGS. 12 and 13, stretcher members 14 are of elongated flat rectangular shape. The stretcher members 14, like the header members, are preferably strengthened by internal reinforcing rods 51 of the known type.

Referring again to FIGS. 3 and 4, thin flat cushions 52 of compressible sheet material are preferably disposed between the tops of the post portions 43 and 44 of the header members 13 and the bases of the next overlying header members. Cushions 53 of similar material are preferably provided between stretcher members 14 and the header members 13 which support the stretcher members.

Figure 14:
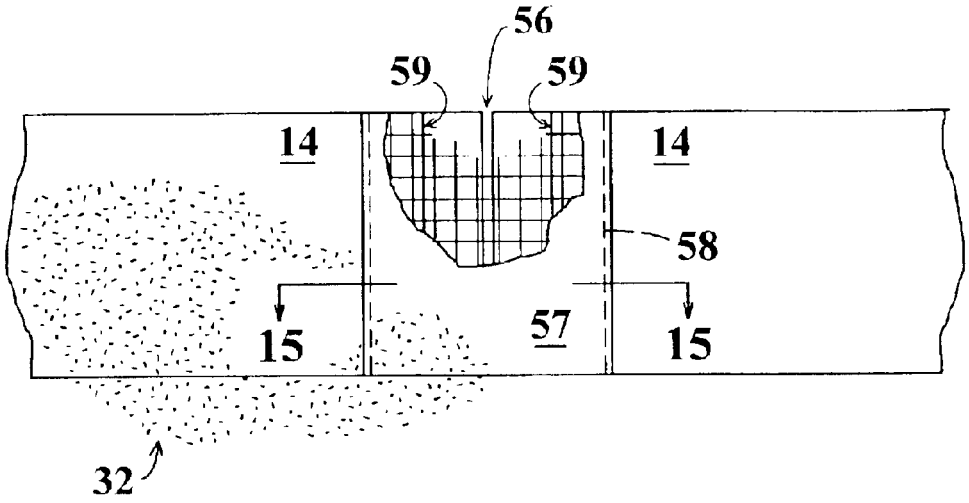
FIG. 14 depicts adjacent ends of two stretcher members and soil retaining components which bridge the adjacent ends.
Figure 15:
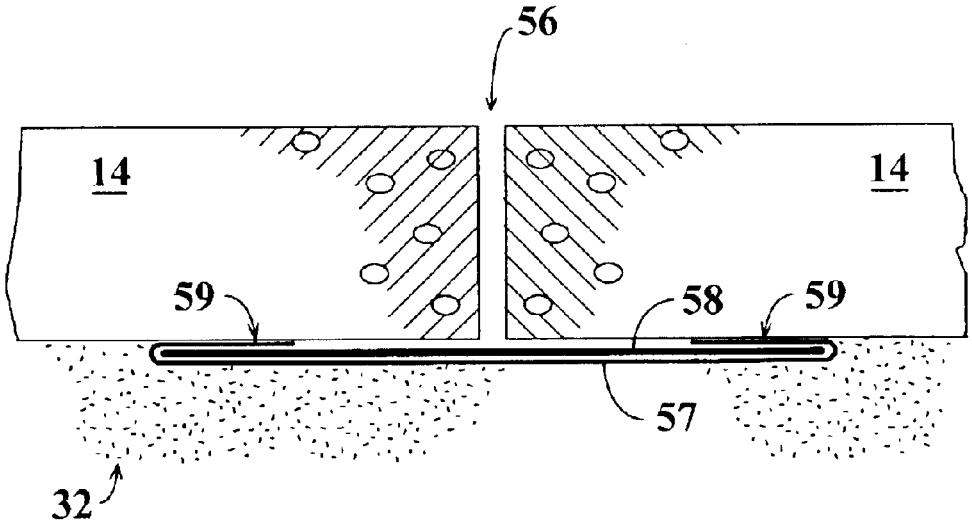
FIG. 15 is an enlarged section view taken along line 15—15 of FIG. 14.

FIG. 14 depicts the rearward facing surfaces of two adjoining stretcher members 14 in one of the horizontal rows of stretcher members. Referring to FIGS. 14 and 15, the stretcher members 14 are proportioned to provide for a small gap 56 between the ends of the two stretcher members. This accommodates the thermal expansion and contraction of the stretcher members 14 and facilitates emplacement of the stretcher members in the wall. Loss of planting soil 32 through the gap 56 is prevented by a sheet 57 of porous material which bridges the gap at the rear facing surfaces of the two stretcher members. The sheet 57 is backed and reinforced by a rectangular section 58 of geosynthetic mesh reinforcement, flaps 59 formed by margins of the sheet material 57 being folded under the vertically extending edge portions of the section 58.

Referring again to FIG. 1, the inclination or slope of the face of the wall 11 is determined by the positioning of the header members 13 relative to each other. Each header member 13 is partially offset in the rearward direction relative to the next underlying header member. The extent of this partial offset is fixed during construction of the wall 11 by the location of the previously described pins 21 which extend between the header members 13. The extent of the partial offset and thus the batter or inclination of the face of the wall 11 can be selected to be appropriate to a particular site by configuring the header members 13 to situate the pins 21 at more forward or more rearward locations along the header members.

Figure 16:
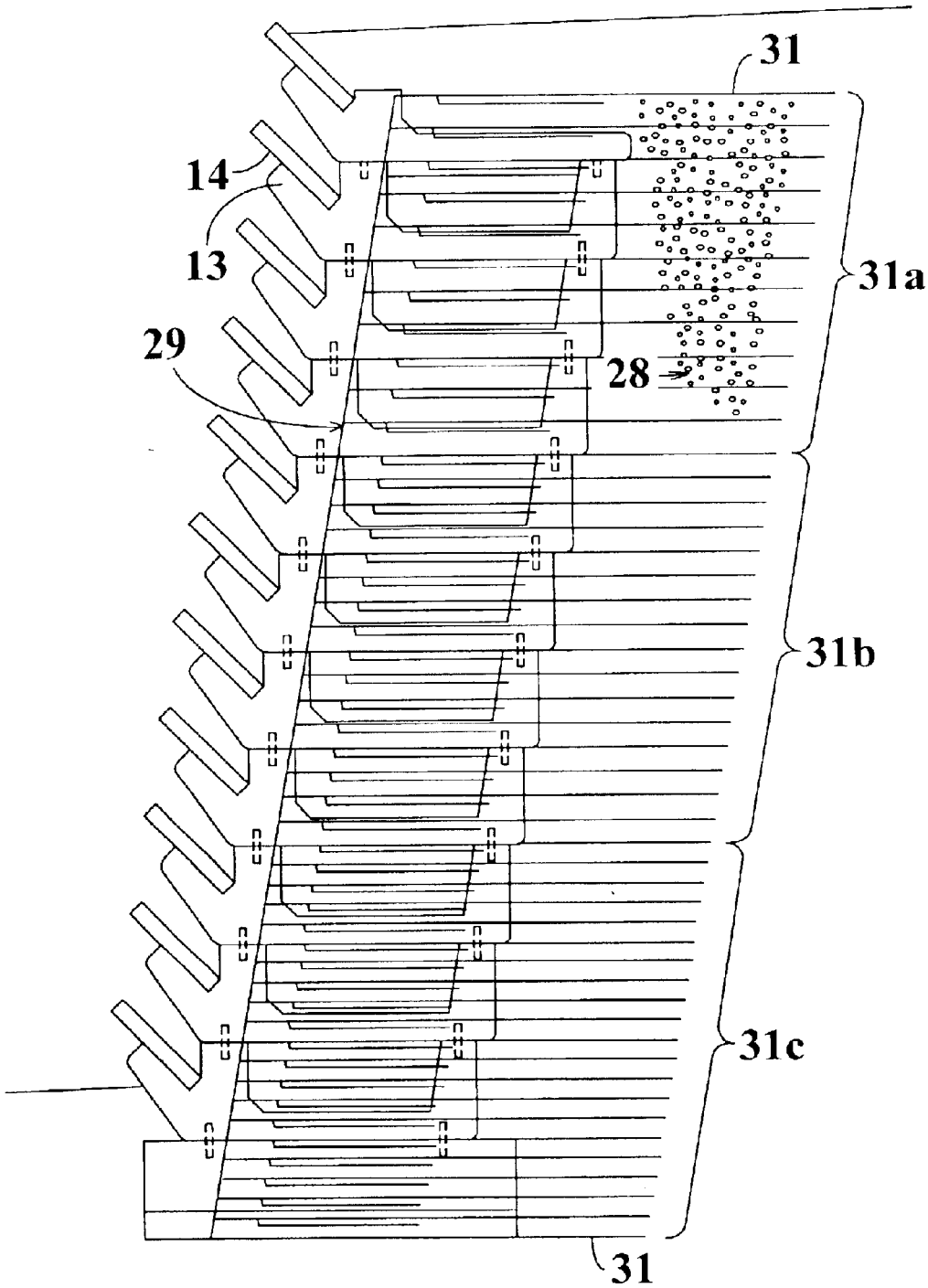
FIG. 16 is an elevation section view of a retaining wall having a non-uniform vertical spacing of geosynthetic mesh reinforcement to accommodate to differing load forces at different levels within the wall.

Referring to FIG. 16, the degree of reinforcement of the load bearing capability of the backfill 28 that is provided by the layers 31 of geosynthetic mesh reinforcement is dependent on the vertical spacing and tensile strength of the layers and increases as the spacing is reduced. Load force in the backfill 28 increases at progressively greater depths in the backfill. Thus it can be advantageous to decrease the spacing of the layers 31 at greater depths and/or to use geosynthetic mesh reinforcement of greater tensile strength at greater depths. FIG. 16 depicts an example in which the layers 31*a* of geosynthetic mesh reinforcement within an uppermost region of the backfill 28 are spaced similarly to the spacing of the layers in the previously described embodiments of the invention. The layers 31*b* of geosynthetic mesh reinforcement are more closely spaced at an intermediate depth within the backfill 28. At the lowermost region of the backfill 28 the layers 31*c* of geosynthetic mesh reinforcement are still more closely spaced.

During construction of the retaining wall 11, with reference again to FIG. 1, emplacement of the header members 13, backfill 28 and layers 31 of geosynthetic mesh reinforcement proceeds in stages. Following emplacement of the header members 13 at each tier of the wall 11, the backfill 28 and layers 31 at that tier of the wall are emplaced before emplacement of the next higher header members. This emplacement of backfill 28 and layers 31 at each tier also proceeds in stages with the backfill which underlies each layer 31 being compacted prior to emplacement of that layer. Stretcher members 14 may be emplaced at any time after the particular header members 13 which support the stretcher member are in place. Planting soil 32 may be emplaced at each tier after emplacement of the layers 31 and backfill 28 is completed up to a higher level or may be deferred until, emplacement of all header members 13 and the associated layers and backfill have been completed. Landscaping of the successive tiers with plants may then proceed.

While the invention has been described with reference to certain specific embodiments for purposes of example, many modifications and variations are possible and it is not intended to limit the invention except as defined by the following claims.

We claim:

1. A retaining wall for stabilizing compacted structural backfill which retaining wall is comprised of:

a plurality of spaced apart columns of header members which extend back into the compacted structural backfill from a front surface thereof and which extend out from the front surface of the compacted structural backfill to a front face of the wall, front ends of the header members having inclined arms which extend outward and upward at the front face of the wall; each of said header members having a substantially flat horizontally extending lower surface, a first vertical post portion extending upwardly from a rear end portion of such header member and a second vertical post portion extending upwardly from a front end portion of said header member rearwardly of said arm, the upper surfaces of said post portions lying substantially in a common plane which is parallel to said horizontally extending lower surface;

a plurality of horizontal stretcher members which extend between the header members at the front face of the wall and which are supported by the inclined arms of the header members;

a plurality of vertically spaced layers of geosynthetic mesh reinforcement extending backward into said compacted structural backfill from the front surface thereof, and a volume of planting soil disposed between each of said stretcher members and the forward surfaces of said second vertical post portions overlying the respective stretcher member and forming exposed tiers of planting soil at said front face of said retaining wall.

2. The retaining wall of claim 1 wherein said front surface of said compacted backfill and the forward ends of said layers of geosynthetic mesh reinforcement are behind said stretcher members and spaced apart therefrom and said volume of planting soil extends continuously upward and downward behind said plurality of stretcher members.

3. The retaining wall of claim 1 wherein each stretcher member is supported by a particular pair of said header members and is spaced apart from the header members which are immediately above said particular pair of header members.

4. The retaining wall of claim 1 wherein header members in said columns thereof are supported by underlying header members, stretcher members being proportioned and positioned to be free of contact with header members other than the particular header members which support a particular stretcher member.

5. The retaining wall of claim 1 wherein the stretcher members extend upward and outward underneath the overlying inclined arms of the header members which are immediately above the header members that support the stretcher member, the stretcher members being spaced from said overlying inclined arms thereby exposing said tiers of planting soil.

6. The retaining wall of claim 1 in which said upper surfaces and said lower surfaces of said header members are provided with holes, and further including pins extending upward from holes in the header members into holes in the overlying header members.

7. The retaining wall of claim 1 further including sheets of fabric disposed within said forward ends of said layers of geogrid mesh and being configured and positioned to form a soil migration barrier between said compacted backfill and said planting soil at said forward ends of said layers of geogrid mesh.

8. The retaining wall of claim 7 wherein said sheets of porous material have intermediate portions which extend upward at said front surface of said compacted structural backfill and have horizontal upper and lower edge portions which extend back into said compacted structural backfill.

9. The retaining wall of claim 1 wherein said stretcher members extend horizontally along said wall in rows of aligned stretcher members which rows are situated at successively greater heights and wherein the stretcher members have a length which is substantially twice the spacing of said columns of header members from each other and wherein abutments between said stretcher members in each horizontal row thereof are situated substantially midway between columns of header members, the abutments in a particular horizontal row of stretcher members being spaced horizontally from the abutments of the adjacent rows by a distance corresponding substantially to one half of said length of said stretcher members.

10. The retaining wall of claim 1 wherein the vertical spacing of a first group of said layers of geosynthetic mesh reinforcement is smaller than the vertical spacing of a second group of said layers of geosynthetic mesh reinforcement, said first group of layers being at a deeper location in said compacted structural backfill than said first group of layers.

11. A retaining wall for stabilizing compacted structural backfill which retaining wall is comprised of:

a plurality of spaced apart columns of header members which extend back into the compacted structural backfill from a front surface thereof and which extend out from the front surface of the compacted structural backfill to a front face of the wall, front ends of the header members having inclined arms which extend outward and upward at the front face of the wall;

a plurality of horizontal stretcher members which extend between the header members at the front face of the wall and which are supported by the inclined arms of the header members;

a plurality of vertically spaced layers of geosynthetic mesh reinforcement extending between the columns of header members and extending backward into said compacted structural backfill from the front surface thereof, the layers of geosynthetic mesh reinforcement having forward ends which turn upward at the front surface of the compacted backfill and then extend back into the compacted backfill; and a volume of planting soil disposed between said stretcher members and the upturned forward ends of the layers of geosynthetic mesh reinforcement and forming exposed tiers of planting soil at said front face of said retaining wall, wherein said header members extend upward through openings in said layers of geosynthetic mesh reinforcement.

12. The retaining wall of claim 11 wherein individual header members have a base portion which extends horizontally and a front post portion situated behind said inclined arm and which extends upward from the base portion through openings in said geosynthetic mesh reinforcement and a rear post portion which extends upward from said base portion through openings in said geosynthetic mesh reinforcement.

13. The retaining wall of claim 12 wherein the base portion of the individual header member has a substantially flat bottom for resting on an underlying header member and wherein said front and rear post portions have substantially flat top surfaces against which an overlying header member is rested.

14. The retaining wall of claim 13 wherein vertical pins extend upward from holes in said top surafces of said front and rear post portions into holes in the bottom of the overlying header member.

15. The retaining wall of claim 13 wherein pads of cushioning sheet material are disposed between said top surfaces of said post portions of said individual header member and the bottom of the overlying header member and are also disposed between the header member and a stretcher member which is supported by the header member.

16. A retaining wall for compacted structural backfill, the retaining wall being comprised of:

a plurality of cast concrete header members stacked in spaced apart vertically extending columns thereof and which extend into the structural backfill from a front face of the wall, the header members of said plurality thereof having bases which rest upon an underlying header member and having front and rear post portions which extend up to the base of an overlying header member, front ends of the header members having arms which extend outward and upward at the face of the wall at locations which are in front of the compacted structural backfill;

a plurality of horizontal stretcher members at the front face of the wall and which are supported by the inclined arms of the header member, the stretcher members being spaced apart from header members other than the particular header members which support the stretcher member;

a plurality of vertically spaced horizontal layers of geosynthetic mesh reinforcement extending between the columns of header members and extending backward therefrom within said compacted structural backfill, the layers of geosynthetic mesh reinforcement being unconnected to said header members and said stretcher members whereby said mesh reinforcement can move independently of and relative to said header members and said stretcher members; and planting soil disposed between said stretcher members and the front post portion of an overlying header member and which forms tiers of said planting soil at the front face of the wall.

17. A retaining wall having a plurality of spaced apart vertical columns of stacked header members which extend into backfill material and a plurality of stretcher members which extend horizontally between front portions of said header members wherein the improvement comprises:

said header members having flat top surfaces and flat bottom surfaces, said surfaces lying in parallel planes, and wherein said wall further includes a plurality of pins each of which extends vertically from a hole in a top surface of a particular one of said header members into a hole in a bottom surface of the next overlying one of said header members to maintain said header members in stacked vertical alignment and wherein each individual one of said plurality of pins extends out of said particular header member only at said top surface thereof and extends out of said next overlying header member only at said bottom surface thereof.

* * * * *